US005501077A

United States Patent [19]

Davis et al.

[11] Patent Number: 5,501,077

[45] Date of Patent: Mar. 26, 1996

[54] THERMOELECTRIC WATER CHILLER

[75] Inventors: S. Spence Davis, Atlanta, Ga.; R. Clark Lucas, Santa Barbara, Calif.; Michael J. Nagy, Williamsburg, Mich.; Anthony E. Yeargin, Charlotte; Gerald M. Zinnbauer, Cornelius, both of N.C.

[73] Assignee: Springwell Dispensers, Inc., Atlanta, Ga.

[21] Appl. No.: 250,364

[22] Filed: May 27, 1994

[51] Int. Cl.[6] ..... F25B 21/02

[52] U.S. Cl. ..... 62/364; 62/390; 62/397

[58] Field of Search ..... 62/3.64, 390, 397

[56] References Cited

U.S. PATENT DOCUMENTS

| | | | |
|---|---|---|---|
| 2,186,900 | 1/1940 | Dick et al. | 62/397 |
| 3,088,289 | 5/1963 | Alex . | |
| 3,296,806 | 1/1967 | Gonzalez . | |
| 3,327,485 | 6/1967 | Ter Bush . | |
| 4,274,262 | 6/1981 | Reed . | |
| 4,320,626 | 3/1982 | Donnelly . | |
| 4,384,512 | 5/1983 | Keith . | |
| 4,629,096 | 12/1986 | Schroer . | |
| 4,681,611 | 7/1987 | Bohner . | |
| 4,744,220 | 5/1988 | Kerner . | |
| 4,792,059 | 12/1988 | Kerner et al. . | |
| 4,804,118 | 2/1989 | Mullen . | |
| 4,829,771 | 5/1989 | Koslow . | |
| 4,833,888 | 5/1989 | Kerner . | |
| 4,913,713 | 4/1990 | Bender . | |
| 4,993,229 | 2/1991 | Baus . | |
| 4,996,847 | 3/1991 | Zickler . | |
| 5,072,590 | 12/1991 | Burrows . | |
| 5,192,004 | 3/1993 | Burrows . | |
| 5,209,069 | 5/1993 | Newnan . | |
| 5,246,141 | 9/1993 | Burrows . | |
| 5,289,951 | 3/1994 | Burrows | 62/390 |
| 5,297,700 | 3/1994 | Burrows et al. | 62/390 |

FOREIGN PATENT DOCUMENTS

| | | |
|---|---|---|
| WO93/08432 | 4/1993 | WIPO . |
| WO93/08433 | 4/1993 | WIPO . |

*Primary Examiner*—Henry A. Bennett
*Assistant Examiner*—Siddharth Ohri
*Attorney, Agent, or Firm*—Cushman Darby & Cushman

[57] ABSTRACT

A thermoelectric water-chiller system for cooling bottled water, and including a mixing valve which enables dispensing of chilled water, room-temperature water, or a mixture of chilled and room-temperature water. Components needing periodic cleaning are readily removable from the system. A fan-cooled thermoelectric-chip assembly is used to form an ice block which chills the water, and a variable-speed fan is controlled by a temperature sensor to slow the fan speed when chilling to a desired temperature is achieved, and to maintain the ice block at an optimum size.

17 Claims, 14 Drawing Sheets

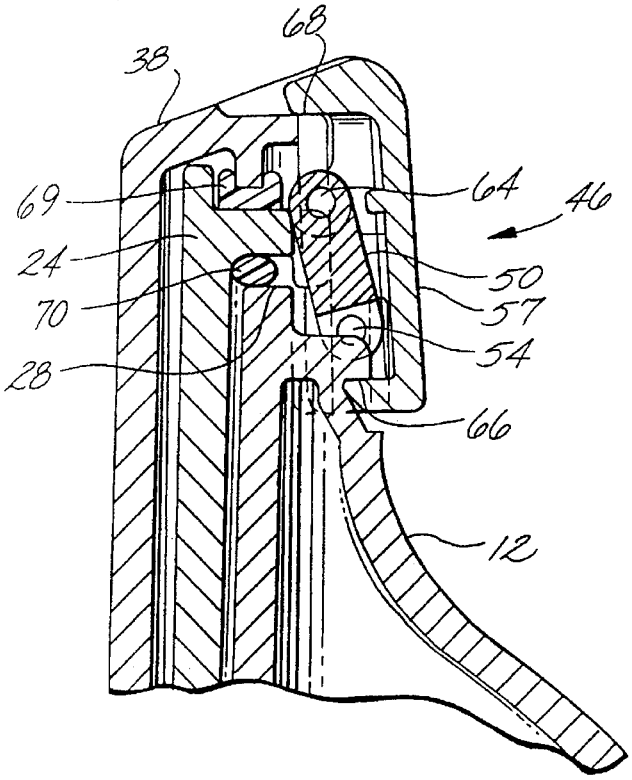
Fig. 9
Fig. 10
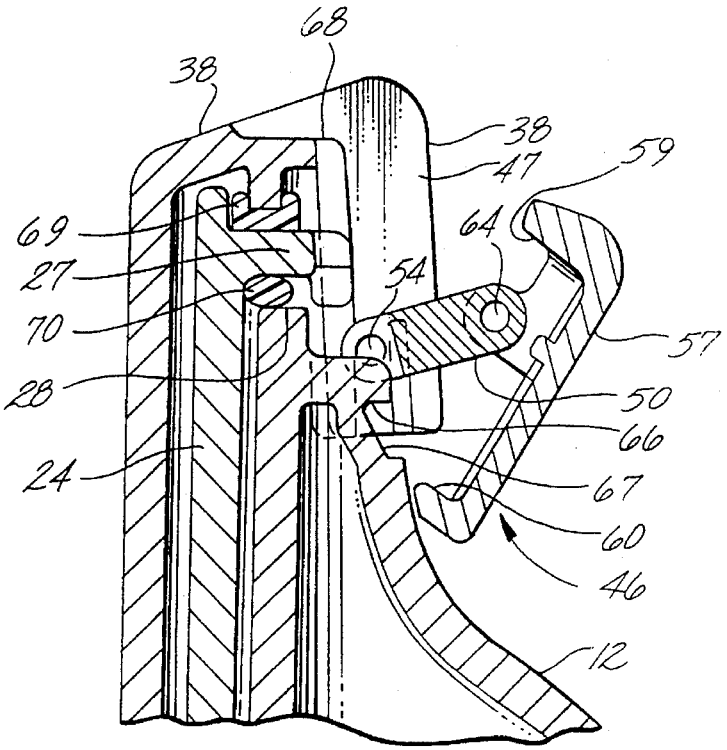

THERMOELECTRIC WATER CHILLER

BACKGROUND OF THE INVENTION

This invention is directed to an improved system for chilling drinking water, the system being particularly suitable for use with bottled drinking water. Water cooling is preferably provided by a thermoelectric heat-transfer module which is quiet and trouble-free as compared to compressor-type coolers. Heat drawn from the water by the thermoelectric module is dissipated by fins which are cooled by fan-driven room air.

The system includes a water reservoir having an upper chamber which holds substantially room-temperature water, and a lower chamber for chilled water, and which rests on a cold sink of the thermoelectric module. Room-temperature water is gradually fed to the lower chamber as water from that chamber is dispensed. A user-adjustable mixing valve which will maintain a preset position enables dispensed water to be drawn from both the room-temperature and chilled water chambers in a proportion which provides a desired water temperature.

SUMMARY OF THE INVENTION

The water chiller of this invention has a thermally insulated outer housing which supports a removable main tank with a lower chamber for holding chilled water, and a thermal-barrier assembly fitted in the tank to define an upper chamber for holding room-temperature water. A thermoelectric cooling system has a cold sink in direct contact with a heat-conducting metal plate forming the bottom of the main tank and acting as a secondary cold sink, and a finned hot sink from which heat is extracted by fan-driven room air. Preferably, the operating rate of this cooling system is controlled by varying the fan speed which in turn regulates the hot-sink temperature and the size of an ice block which forms in the lower chamber.

The tank and thermal-barrier assembly are secured to the housing by latches or clips which can be released to enable removal, without use of tools, of the tank and barrier assembly for convenient periodic cleaning in a dishwasher. An adjustable proportioning valve is coupled to both the chilled and room-temperature chambers to permit mixing of room-temperature and chilled water so the dispensed water is of a desired temperature. The valve is readily removable from the tank for cleaning.

DESCRIPTION OF THE DRAWINGS

FIG. 9 is a side sectional elevation of a latch assembly in a closed position;

FIG. 10 is a view similar to FIG. 9, but with the latch assembly in an open position;

DESCRIPTION OF THE PREFERRED EMBODIMENT

Figure 1:
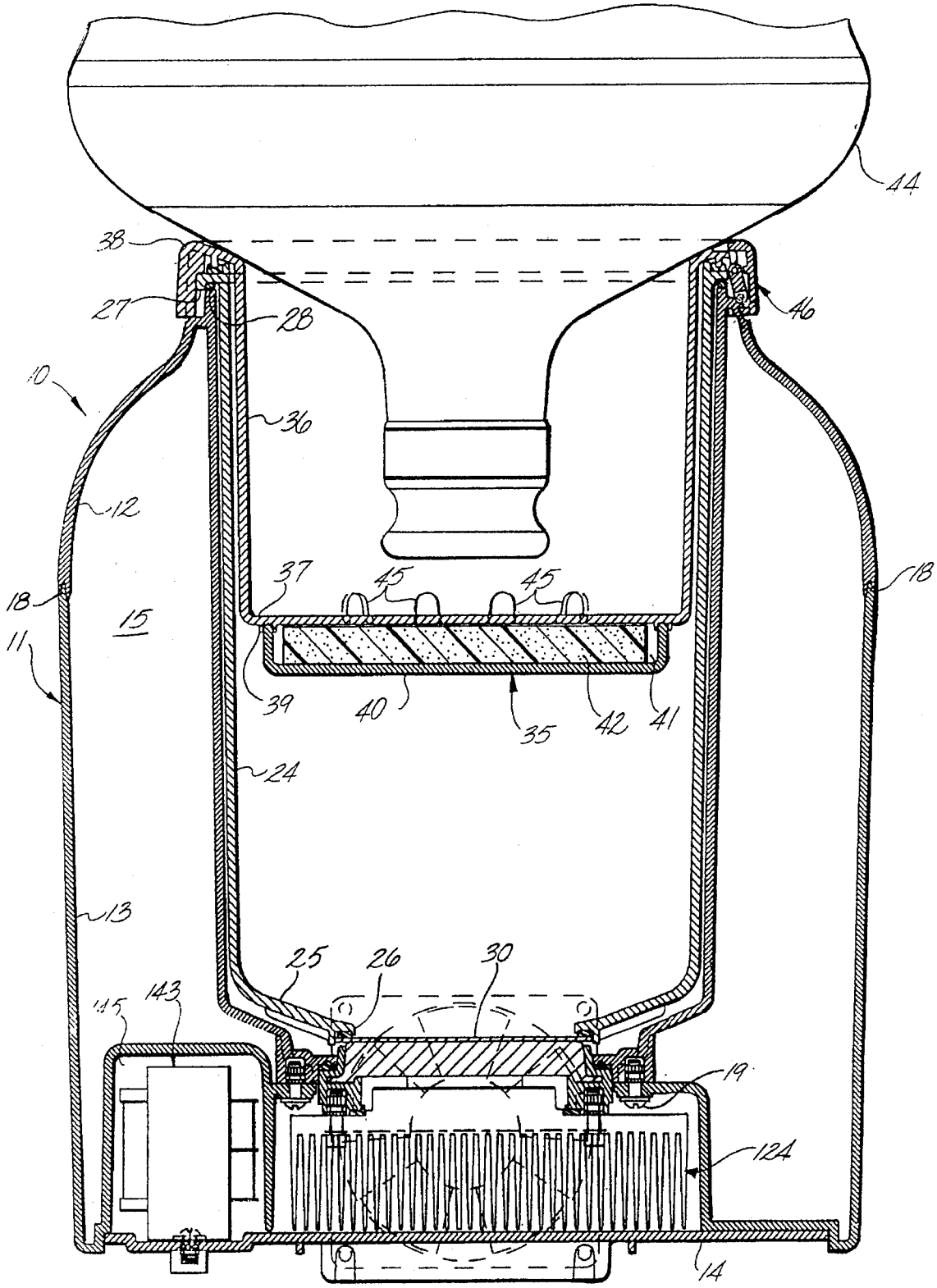
FIG. 1 is a sectional elevation of a thermoelectric water-chiller system according to the invention.
Figure 2:
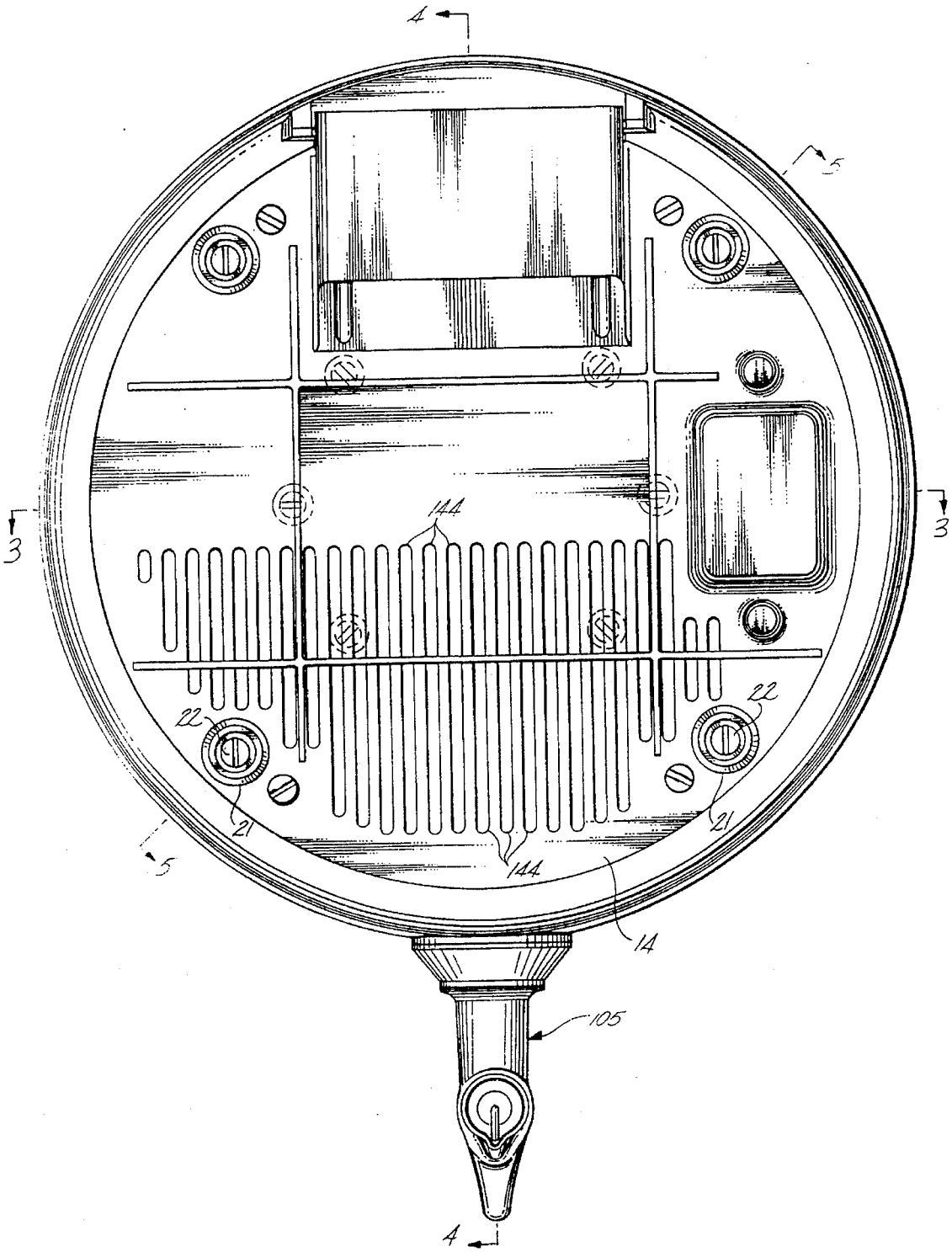
FIG. 2 is a bottom view of the system.

A water-chiller system 10 is shown in FIGS. 1–5, the system having a double-wall and generally cylindrical outer housing 11 with an upper shell 12, a lower shell 13, and a circular base panel 14. The upper and lower shells define an enclosed annular space 15 which is preferably filled with a thermal insulating material such as closed-cell polyurethane or polystyrene foam plastic. The shells are joined together at an outer annular joint 18, and by two threaded fasteners 19 at 180° spacing around the lower end of the upper shell. The system is supported on four feet 21 (FIG. 5) which, along with base panel 14, are secured to the housing by threaded fasteners 22.

Figure 5:
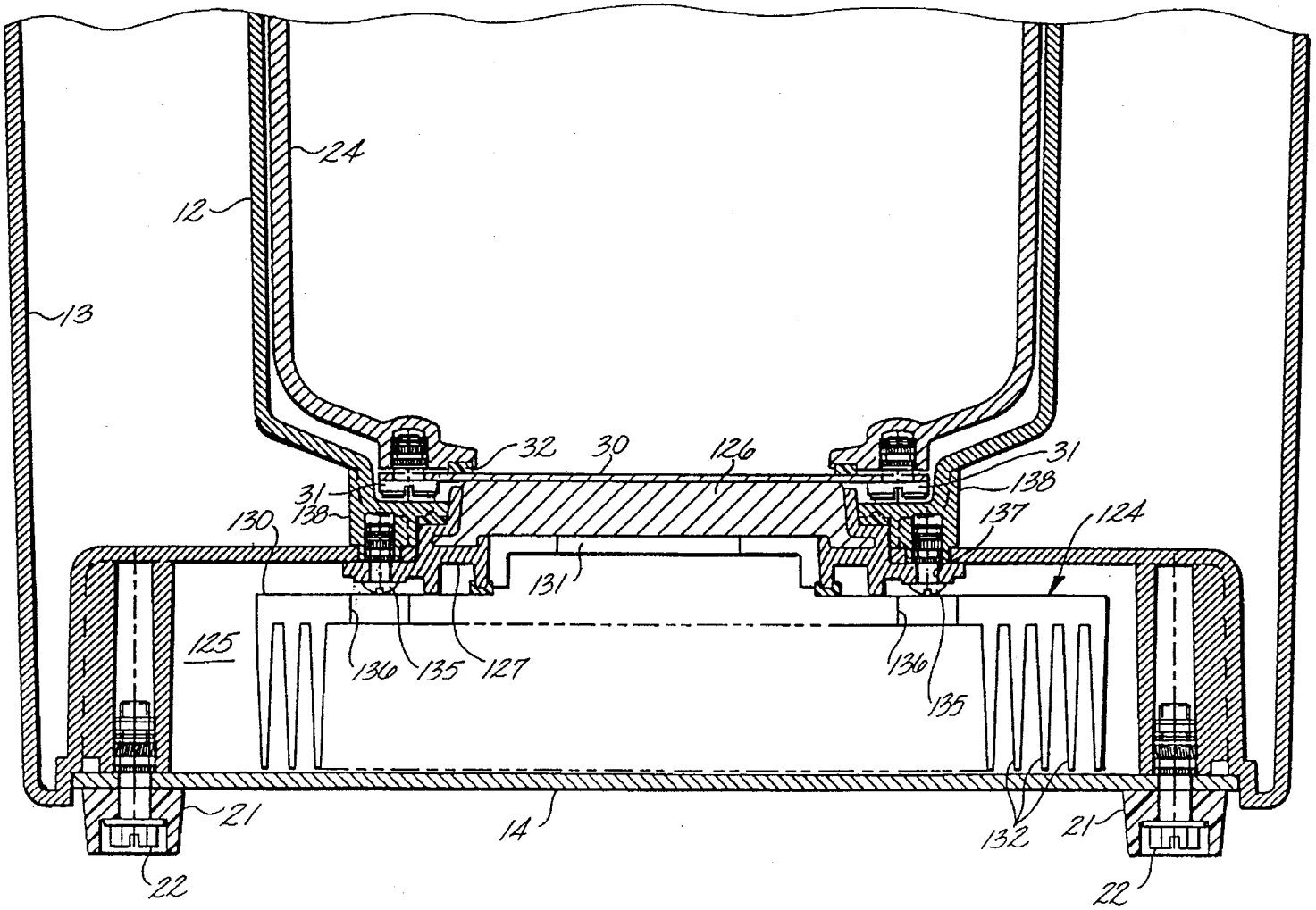
FIG. 5 is a sectional elevation on line 5—5 of FIG. 2.
Figure 7:
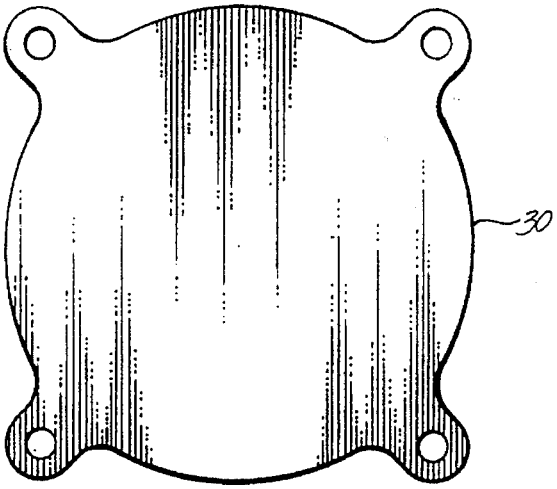
FIG. 7 is a plan view of a main tank bottom plate.

A generally cylindrical main tank 24 for holding chilled water has an inwardly tapered bottom portion 25 defining a central circular opening 26. The upper end of the tank has a radially outwardly extending annular lip 27 which seats on a resilient seal ring against an upper end 28 of upper shell 12 when the tank is fitted within the housing as shown in FIG. 1. The bottom of the tank is closed by a thin stainless-steel circular plate 30 (FIG. 7) which extends across opening 26, and is secured in place by four screws 31 (FIG. 5). A thick resilient ring-shaped gasket 32 between the tank and plate provides a fluid-tight seal.

To minimize heat transfer between room-temperature and chilled water in the system, a thermal-barrier assembly 35 is fitted within the upper end of main tank 24 to form an upper chamber for the room-temperature water. The assembly has a generally cylindrical sidewall 36, and a bottom wall 37. An outwardly and downwardly extending annular lip 38 extends from the upper end of sidewall 36 to overhang and rest against the upper end of the main tank.

Figure 8:
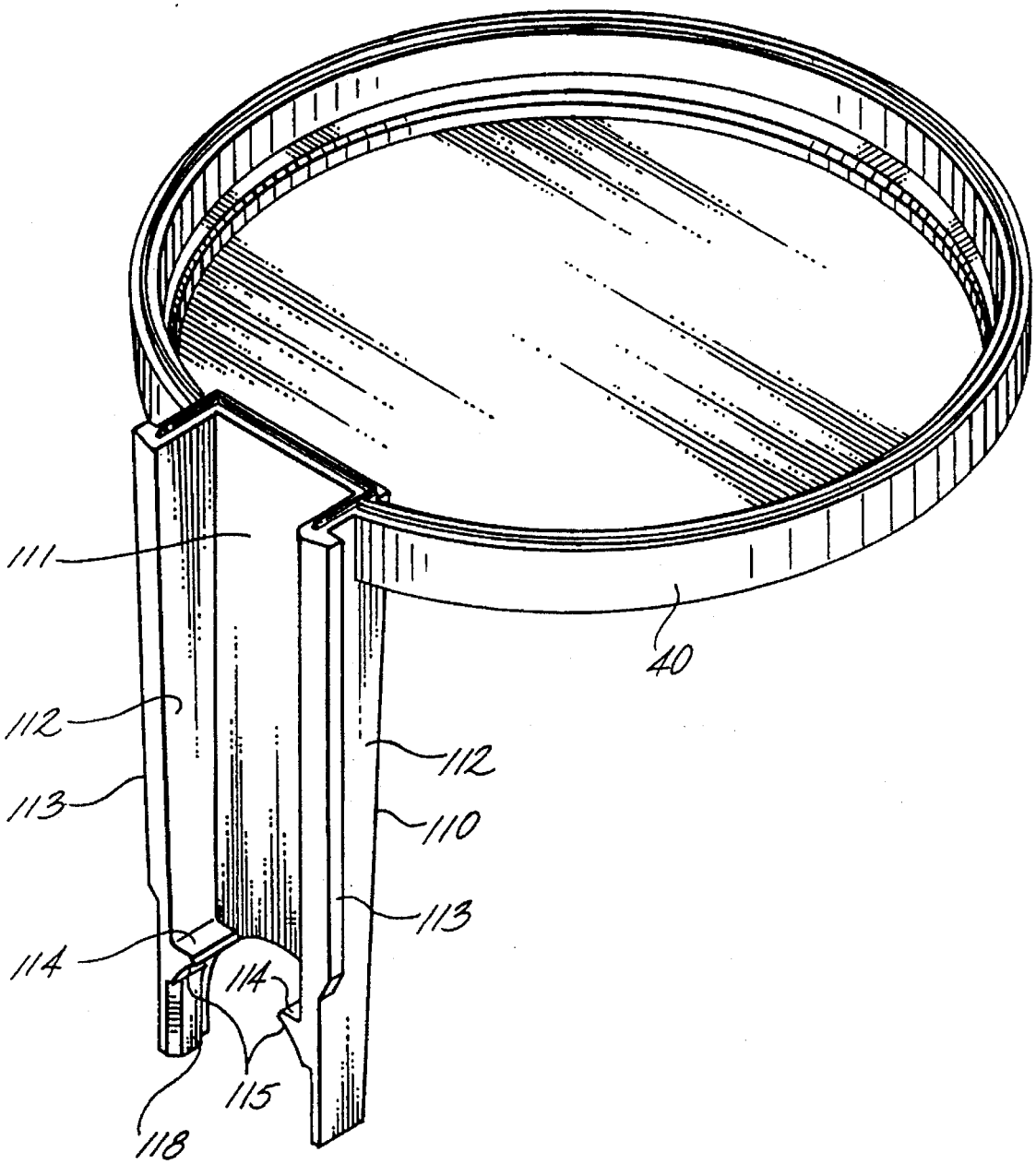
FIG. 8 is a pictorial view of a bottom cover and channel portion of a thermal-barrier assembly of the system.

An annular recess 39 is formed in the undersurface of bottom wall 37, and a circular bottom cover 40 (FIGS. 1 and 8) is secured (e.g., by sonic welding) at its upper edge in the recess. A space 41 defined between the bottom wall and bottom cover is filled with a circular disk 42 of a thermally insulating material such as polystyrene foam plastic.

As shown in FIG. 1, a conventional five-gallon water bottle 44 is inverted and supported on annular lip 38 of the thermal-barrier assembly. Bottled water at room temperature thus fills the upper chamber of system 10 within sidewall 36 above bottom wall 37, and is admitted to a lower chamber of main tank 24 through sidewall openings 45. In an alternative form, sidewall 36 can be replaced with a series of struts (not shown) between which water can flow around the thermal barrier (which can be enlarged in diameter) into the lower chamber. In either case, the desired effect is to maintain stratification of the room-temperature water and chilled water, and thereby to achieve rapid chilling of water in the lower part of the main tank. Use of a plurality of relatively small flow passages from the upper chamber to the lower chamber provides low-velocity admission of warm water to minimize swirling and mixing of water in the lower chamber.

Figure 11:
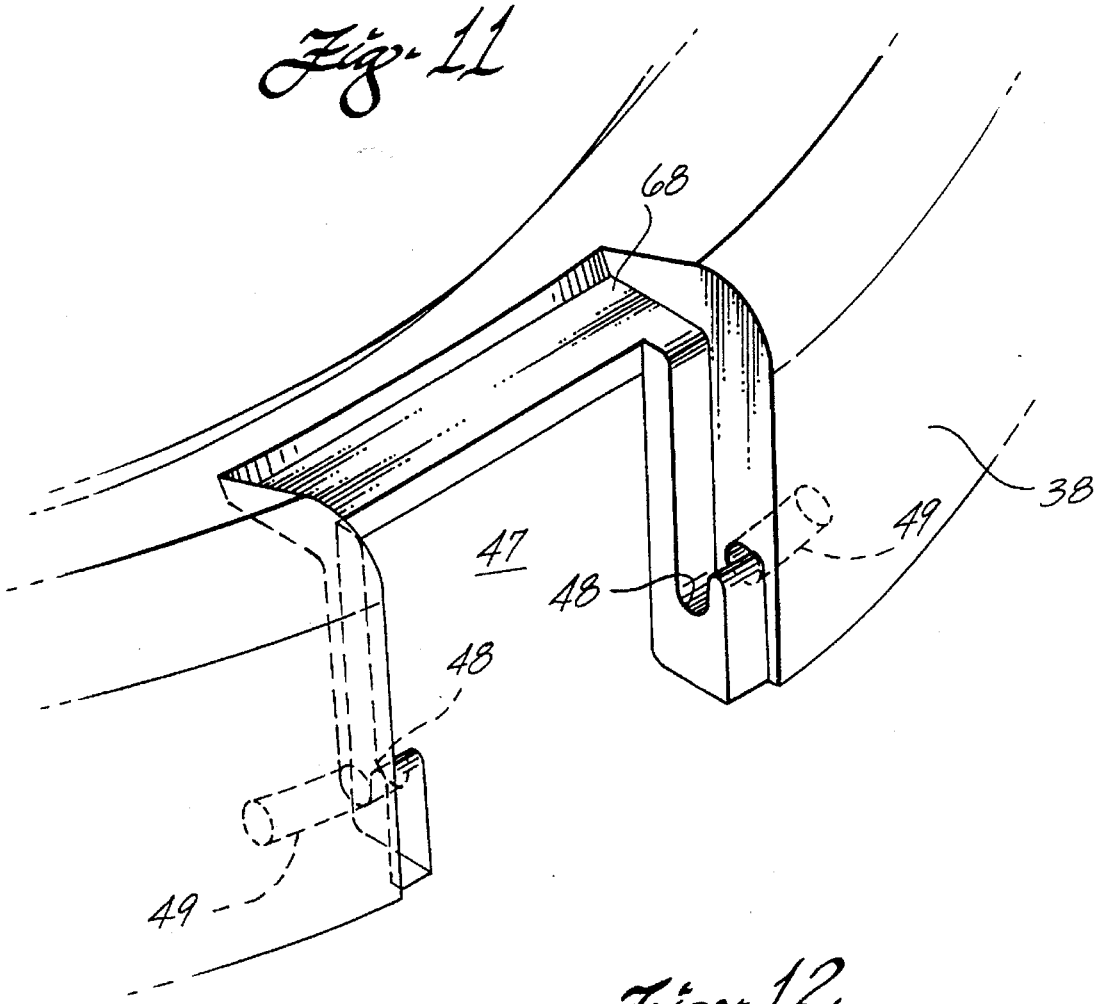
FIG. 11 is a pictorial view of a portion of an upper rim of the thermal-barrier assembly showing a latch-assembly seat.

The main tank and thermal-barrier assembly are secured within housing 11 by three or four circumferentially spaced fastening-means latch assemblies 46 shown in detail in FIGS. 9–15. The assemblies are fitted in recesses 47 formed in lip 38 which is the upper and outer rim of the thermal-barrier assembly as shown in FIG. 11. A pair of spaced-apart and upwardly open saddles 48 are formed in the opposed sides of each recess 47, and blind cylindrical sockets 49 in alignment with the saddles extend into lip 38.

Figure 12:
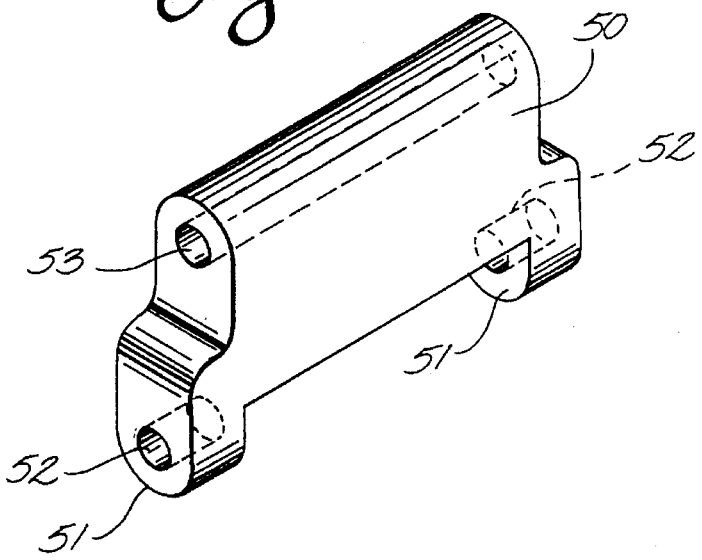
FIG. 12 is a pictorial view of a link for the latch assembly.

A link 50 used in each latch assembly is best seen in FIG. 12, and is a molded plastic part with a pair of spaced-apart lower ears 51 through which are formed coaxial bores 52. A bore 53 extends longitudinally through an upper portion of the link, and the axes of bores 52 and 53 are parallel. The link is hinged to and supported in recess 47 by a pair of spaced-apart pins 54 (FIGS. 9 and 10) fitted through bores 52 to extend across and rotatably rest on saddles 48, with the outer ends of the pins making a press fit into blind sockets 49.

Figure 13:
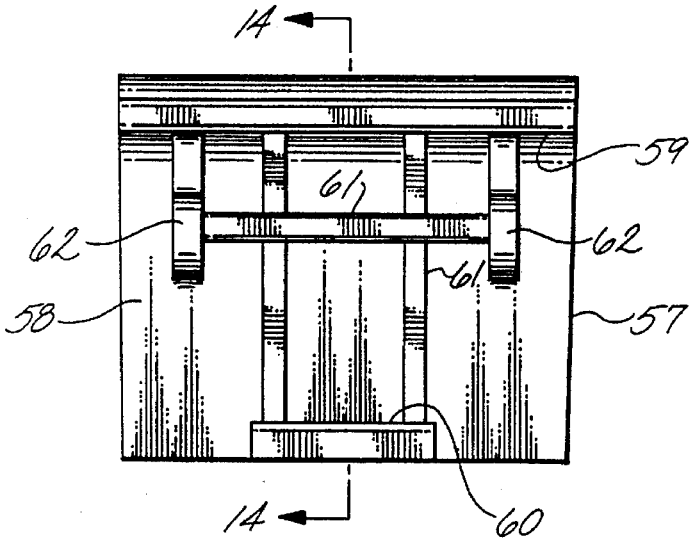
FIG. 13 is a rear elevation of a clip for the latch assembly.
Figure 14:
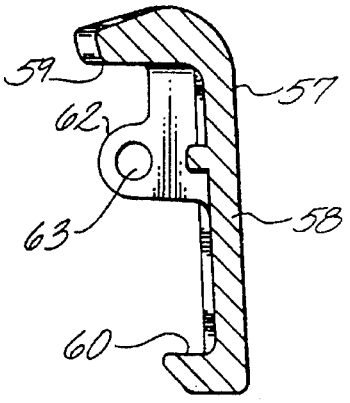
FIG. 14 is a sectional elevation on line 14—14 of FIG. 13.
Figure 15:
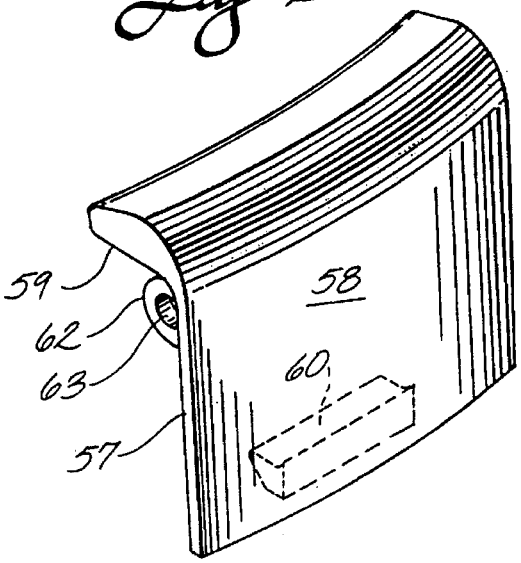
FIG. 15 is a pictorial view of the clip.

A clip 57 used in each lock assembly is best seen in FIGS. 13–15, and is an integrally molded plastic part having a sidewall 58, and an upper locking tongue 59 extending inwardly from the upper end of the sidewall. A lower locking tongue 60 extends inwardly from the lower end of the sidewall, and stiffening ribs 61 are formed on the inner surface of the sidewall. A pair of spaced-apart ears 62 also extend from the inner surface of the sidewall, and the ears have coaxial bores 63 therethrough. The upper portion of link 50 is fitted between ears 62, and the link and clip are pivotally secured together by a pin 64 (FIGS. 9–10).

The latch assembly is shown in an open or disengaged position in FIG. 10, and the main tank and thermal-barrier assembly can be upwardly withdrawn from the system outer housing when the lock-assembly clips are so positioned. When these components are reinstalled in the outer housing, each clip 57 is hinged upwardly and inwardly to engage lower locking tongue 60 against a shoulder 66 formed at the upper part of a recess 67 in the outer surface of upper shell 12 of the outer housing (FIGS. 9–10). The clip is then further pressed inwardly to the closed position shown in FIG. 9 with upper locking tongue 59 extending over and pressed against shoulders 68 (FIG. 11) formed at opposite ends of each recess 47 of the upper rim of the thermal-barrier assembly. Resilient annular seals 69 and 70 are positioned between the thermal-barrier assembly, main tank, and outer housing (FIGS. 1 and 9–10) to prevent entry of moisture into the spaces between the main tank and outer housing.

A particular feature of this invention is a proportioning valve assembly 73 (FIGS. 4 and 16–19) which enables dispensing of chilled water only, room temperature water only, or a selectable mixture of chilled and room-temperature water. The valve assembly extends through and is supported by a horizontally positioned cylindrical outer tube 74 which extends through openings 75 and 76 in upper and lower shells of the housing, and is clamped in place by an inner snap-in retaining ring 77 fitted against an O-ring seal 78.

The valve assembly includes a cylindrical outer sleeve 80 (FIGS. 16–17) with an enlarged and outwardly tapered head 81 at its outer end. An annular recess 82 is formed in the tapered head, and extends circumferentially about 100°. A bore 83 extends axially through the sleeve, and the diameter of the bore is slightly decreased as it passes through an inner end wall 84. A pair of oppositely oriented keyway slots 85 spaced at 180° are formed in the end wall. A pair of oppositely oriented upper and lower rectangular ports 86 and 87 are spaced at 180°, and formed through the sidewall of the outer sleeve adjacent the end wall. Annular grooves 88 and 89 are provided on the sleeve outer surface to receive O-ring seals.

A rotatable intermediate sleeve 91 (FIGS. 16 and 19) makes a slip fit within bore 83 of the outer sleeve, and has at its outer end a radially extending flange 92 which seats in a mating recess in head 81 of the outer sleeve. A rotation arm 93 extends radially from flange 92, and the arm seats in annular recess 82 such that arm movement (and hence rotation of the intermediate sleeve) is limited by the extent of the recess. The intermediate sleeve has an inner portion 94, and a 180° slot 95 is formed through the sidewall of this portion adjacent the inner end of the sleeve.

A fixed-position inner sleeve 98 (FIGS. 16 and 18) makes, a slip fit within the intermediate sleeve, and has at its inner end an enlarged head 99 which seats against the inner end of outer sleeve 80. A bore 99A extends through the inner sleeve to terminate at head 99. A pair of opposed 180°-spaced lugs or keys 100 extend axially from the inner side of the head, and are positioned to mate with keyway slots 101 (FIG. 16) in the end wall of the outer sleeve. A pair of 180°-spaced opposed ports 103 extend through the sidewall of the inner sleeve into bore 99A adjacent head 99.

An outer end 104 of sleeve 98 is threaded to receive a conventional dispensing valve or spigot 105 (FIGS. 4 and 16) having at its inner end a flange 106 which is positioned immediately adjacent or against the outer end of tapered head 81 of outer sleeve 80. The outer sleeve and intermediate sleeve are thus clamped between flange 106 and enlarged head 99 at the inner end of inner sleeve 98, enabling valve assembly 73 to be inserted into or withdrawn from the housing as a unit. Flange 92 of intermediate sleeve 91 is dimensioned to make a slip fit against flange 106 of the spigot to permit rotation of the intermediate sleeve. The inner portion of the valve assembly extends through a circular opening 108 formed in the lower sidewall of tank 24 to position lower port 87 of outer sleeve 80 in communication with chilled water in the tank.

A vertical channel 110 (FIGS. 8 and 16) is integrally formed with and extends downwardly from one side of bottom cover 40 of thermal-barrier assembly 35. Channel 110 performs the dual functions of conveying room-temperature water from above the thermal-barrier assembly to valve assembly 73, and clamping the inner end of the valve assembly within the lower end of tank 24.

Channel 110 has a base 111, and a pair of radially outwardly extending and spaced-apart sidewalls 112 which define at their outer ends oppositely extending circumferential ribs 113. A pair of inwardly extending shoulders 114 are formed at a lower portion of sidewalls 112, and lower surfaces 115 of the shoulders are cylindrically curved to fit against the inner portion of outer sleeve 80. An O-ring seal 117 is fitted in groove 89 around the outer sleeve to seal the valve assembly to the tank. Sidewalls 112 also define inwardly extending ribs 118 dimensioned to make a snug slip fit within keyway slots 85 of the outer sleeve.

Figure 4:
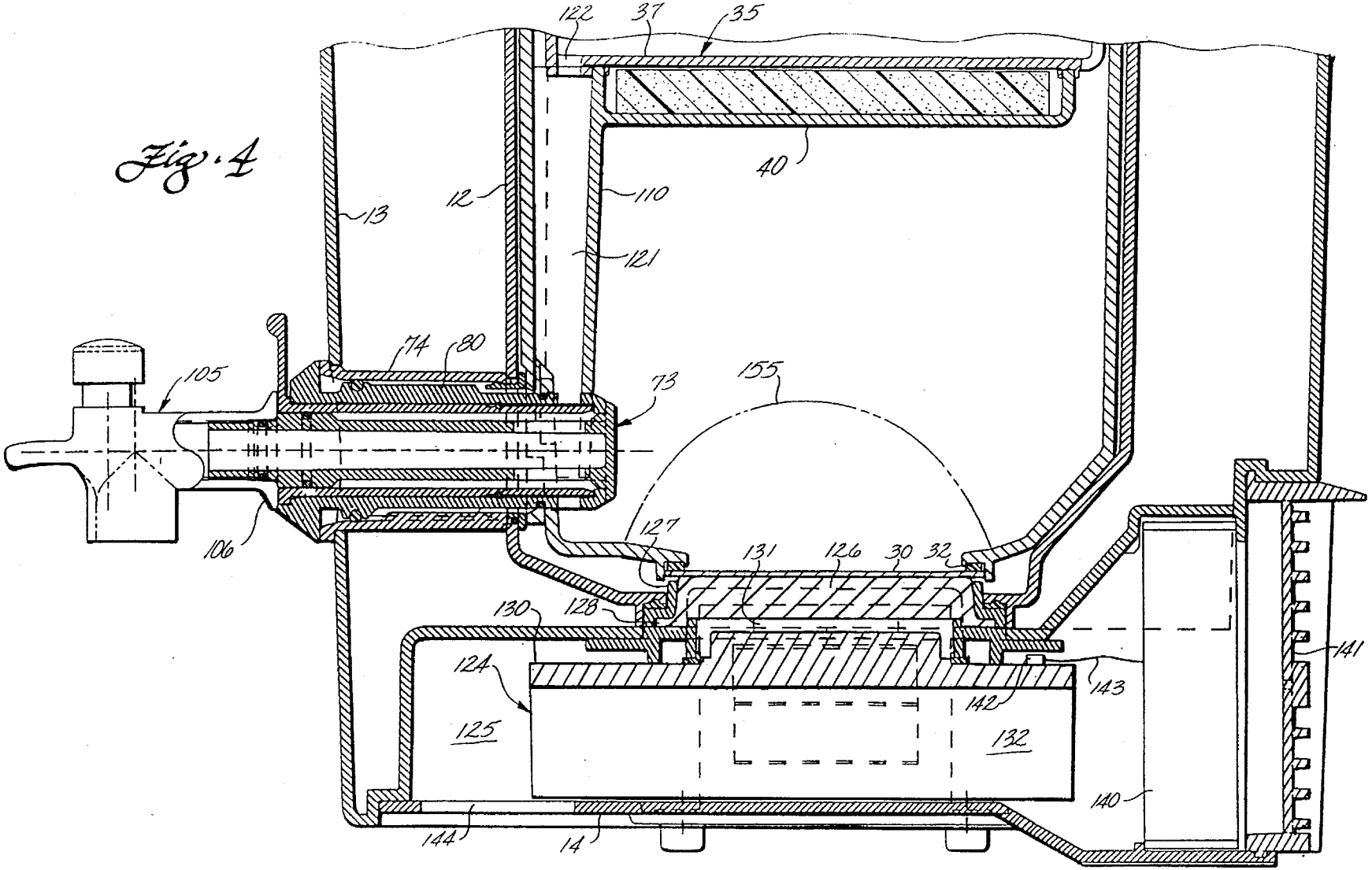
FIG. 4 is a sectional elevation on line 4—4 of FIG. 2.
Figure 6:
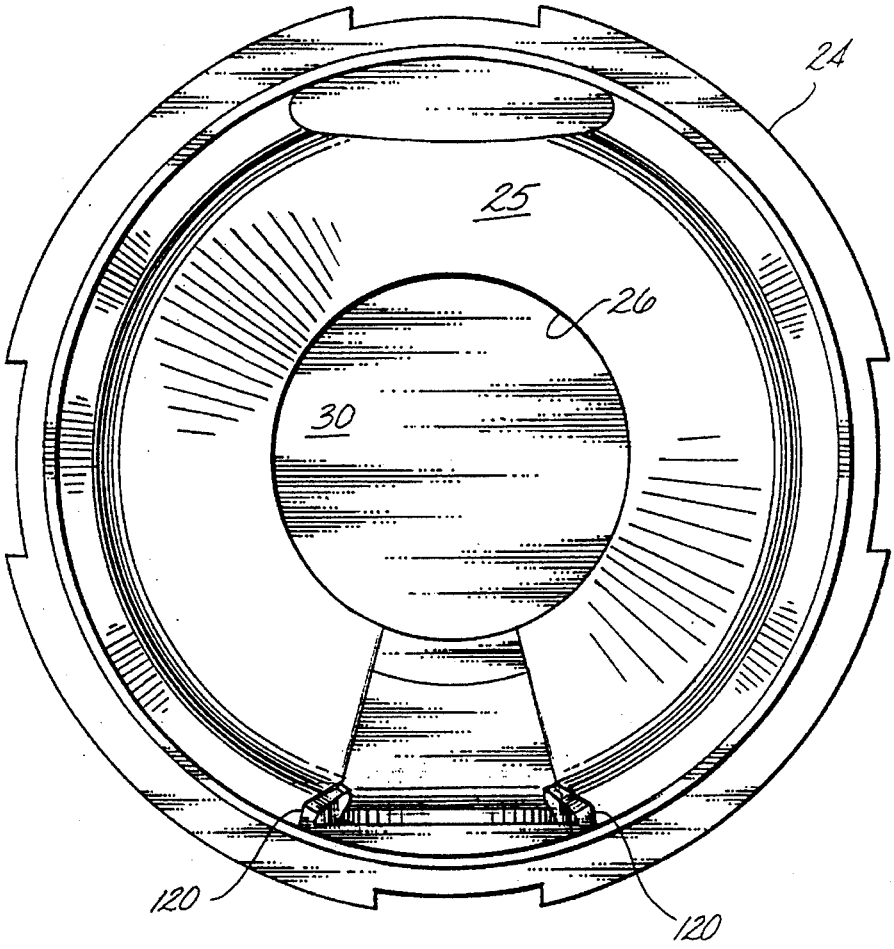
FIG. 6 is a top view of a main tank of the system.
Figure 16:
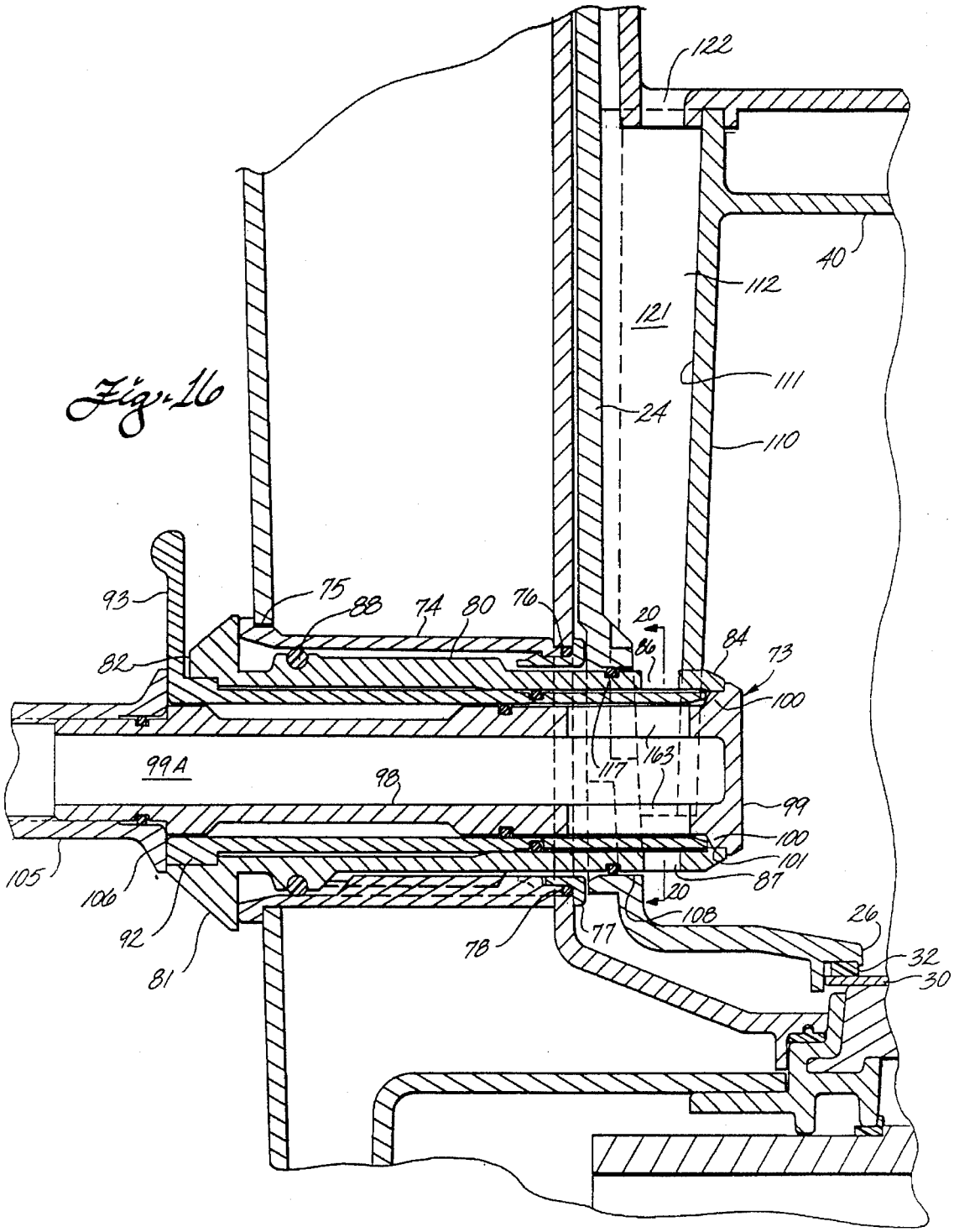
FIG. 16 is an enlarged sectional elevation of a proportioning valve assembly.
Figure 17:
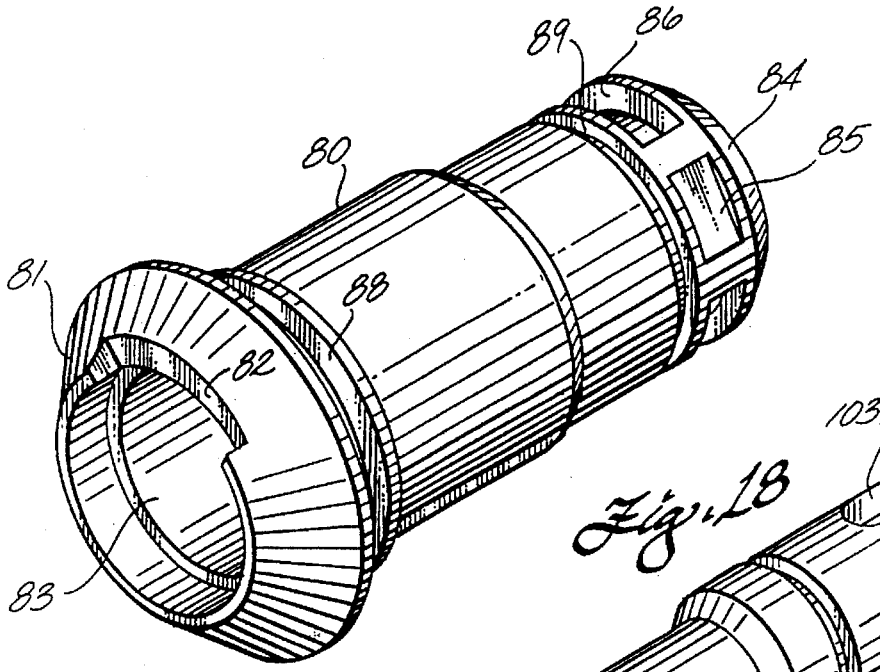
FIG. 17 is a pictorial view of an outer sleeve of the valve assembly.
Figure 18:
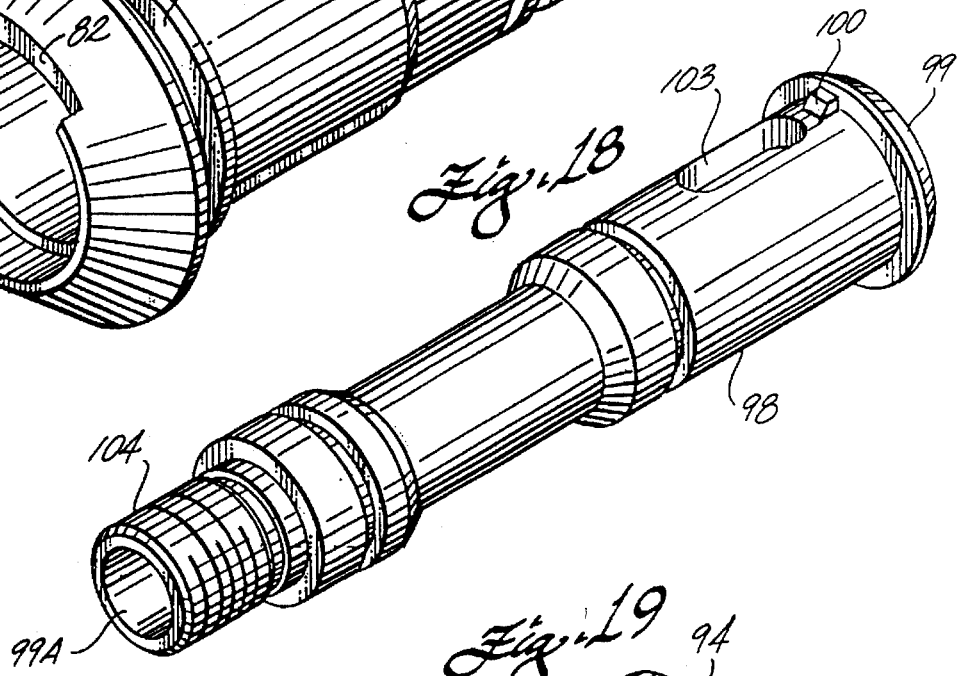
FIG. 18 is a pictorial view of an inner sleeve of the valve assembly.
Figure 19:
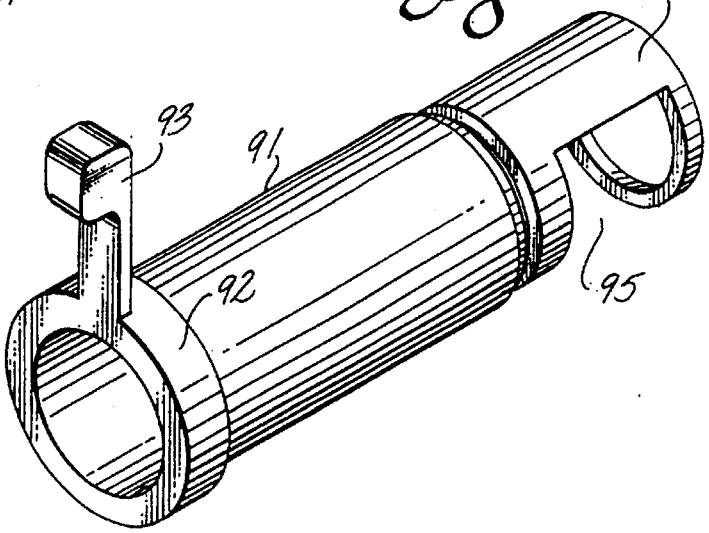
FIG. 19 is a pictorial view of a rotatable intermediate sleeve of the valve assembly.
Figure 20:
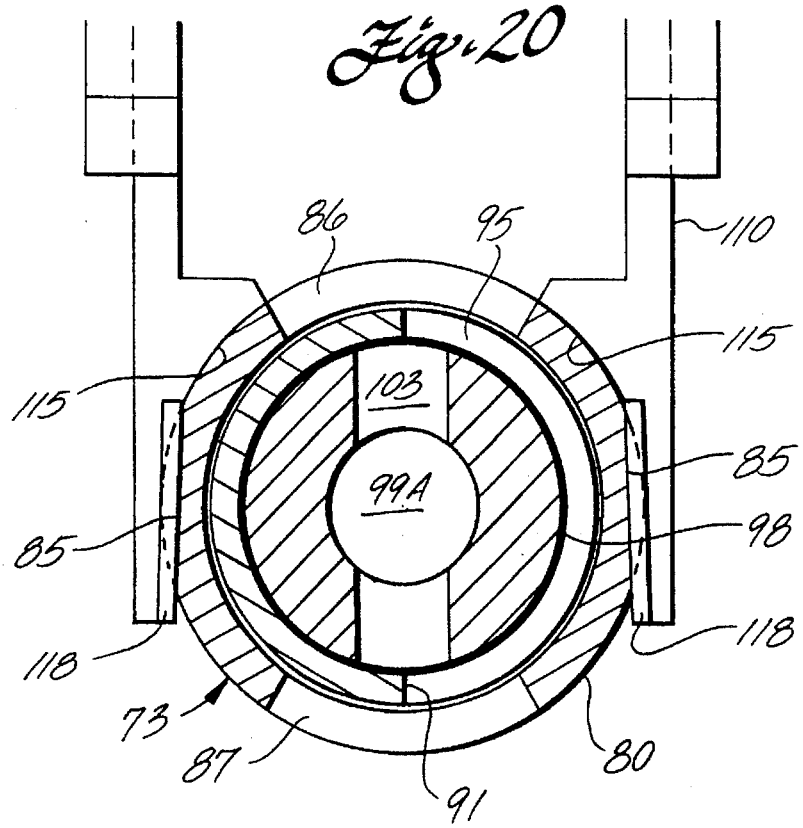
FIG. 20 is a sectional view on line 20—20 of FIG. 16.
Figure 21:
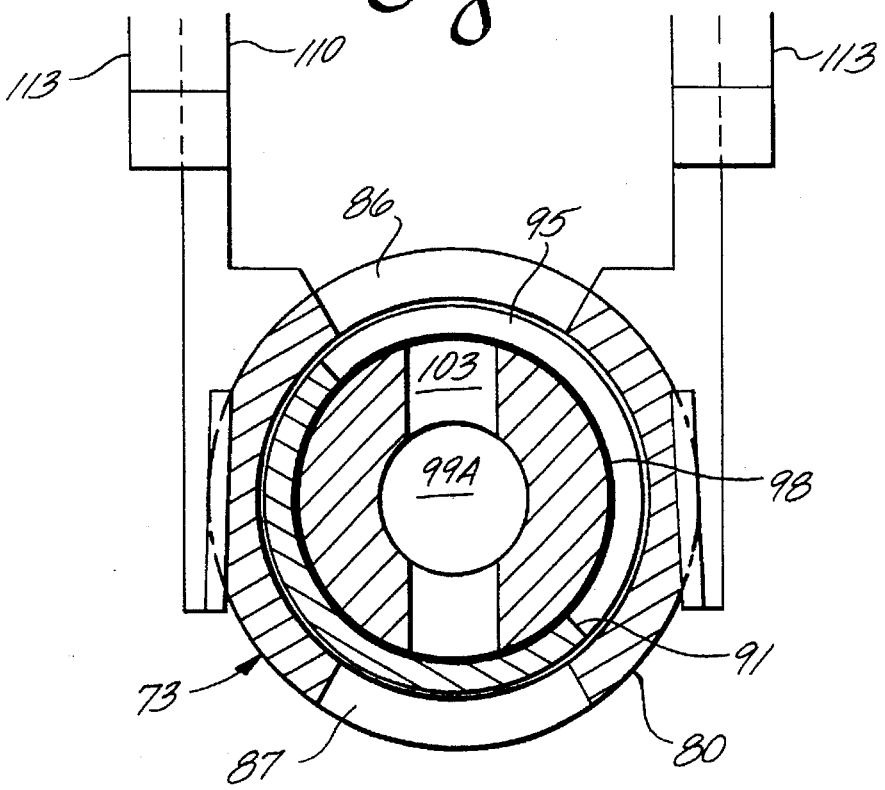
FIG. 21 is a view similar to FIG. 20 showing the rotatable sleeve of the valve assembly in a different position.

As best seen in FIG. 6, a pair of downwardly and inwardly extending spaced-apart tapered guide ribs 120 are integrally formed in the inner surface of tank 24. Ribs 113 of channel 110 of the thermal-barrier assembly make a snug slip fit within mating guide ribs 120 to clamp the channel sidewalls in sealed engagement against the inner sidewall of the tank. Channel 110 and the tank sidewall between guide ribs 120 thus form a conduit 121 permitting room-temperature water to flow by gravity through a port 122 (formed through bottom wall 37 as shown in FIGS. 4 and 16) to upper port 86 of the valve-assembly outer sleeve (FIGS. 20–21).

A thermoelectric chilling assembly 124 (FIGS. 3–5) is positioned in a space 125 at the bottom of system 10 between base panel 14 and the lower end of outer housing 11. Assembly 124 has at its upper end a thick circular aluminum cold-sink plate or disk 126 around the perimeter of which is insert-molded a plastic clamping ring 127 which engages a radially outwardly extending flange 128 on the lower end of the disk. A hot-sink aluminum block 130 is positioned below and slightly spaced from the undersurface of disk 126, and a thermoelectric chip 131 (commercially available types such as supplied by Materials Electronic Products Corporation in Trenton, N.J. are suitable) is sandwiched tightly between the top of block 130 and disk 126. The lower part of block 130 defines a plurality of downwardly extending heat-dissipating fins 132.

Figure 3:
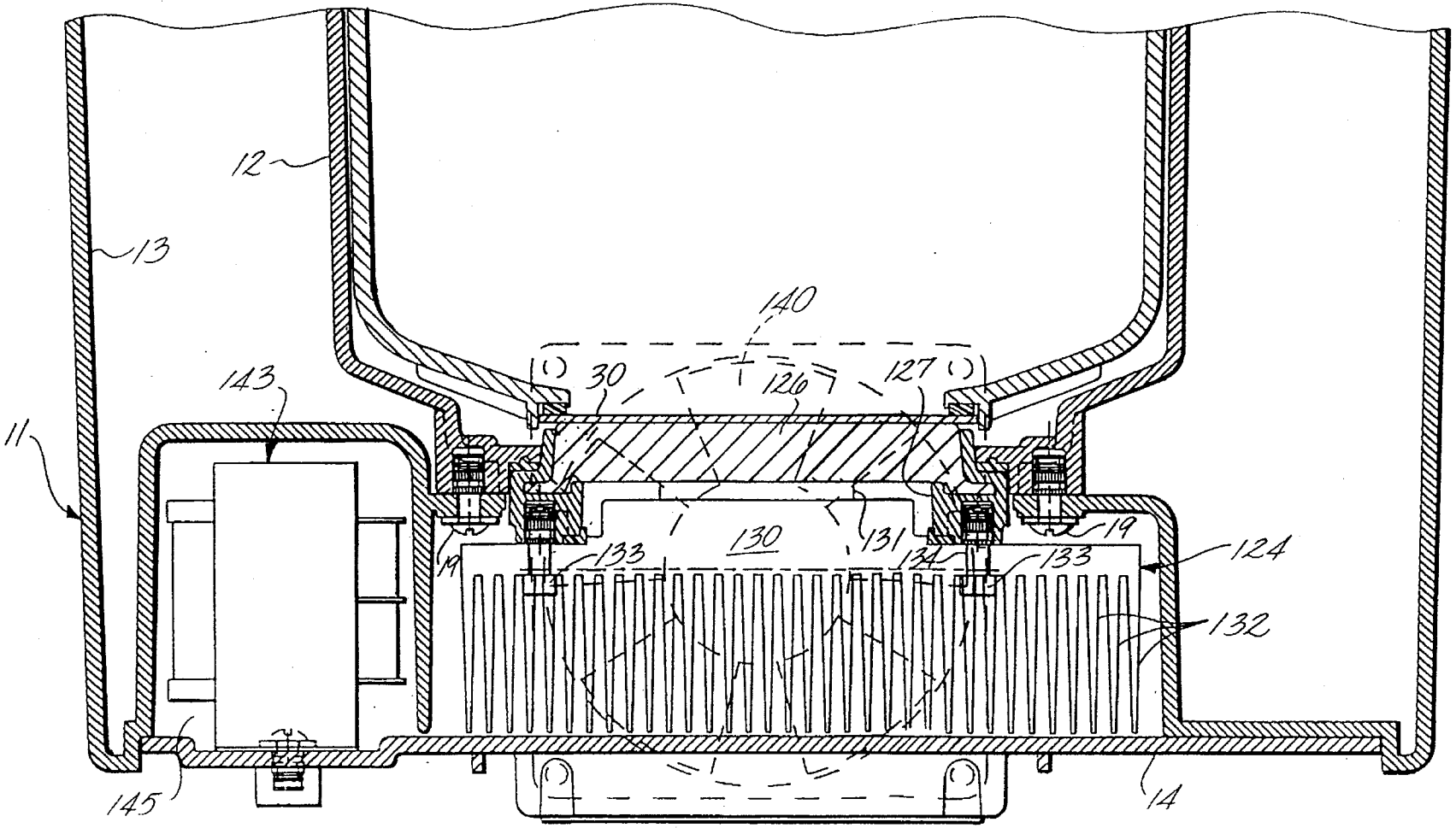
FIG. 3 is a sectional elevation on line 3—3 of FIG. 2.

The components of chilling assembly 124 are secured together by four 90°-spaced bolts 133 with shanks passing through clearance holes 134 in block 130 to thread into clamping ring 127 as shown in FIG. 3. Assembly 124 is in turn secured to the undersurface of upper shell 12 of the outer housing by four 90°-spaced bolts 135 (the heads of which are accessible through openings 136 in the hot-sink block) having shanks which pass through clearance holes 137 in the clamping ring to thread into bosses 138 at the bottom of upper shell 12 as shown in FIG. 5.

A thermally controlled variable-speed fan 140 (FIG. 4) is secured to base panel 14, and slides upwardly into a cavity formed at the lower end of outer-housing lower shell 13 when the base panel is installed. An apertured air-outlet grill 141 is supported on the lower shell adjacent the discharge side of the fan. A temperature sensor such as a thermistor 142 (other types of temperature transducers such as a self-generating thermocouple are of course also suitable when used with compatible circuitry) is secured to the hot-sink block, and is coupled to speed-control circuitry in fan 140 by a cable 143. Outside room air is drawn by the fan through a plurality of inlet slots 144 (FIG. 2) formed through base panel 14 to pass over and draw heat from fins 132.

Fan 140 is of a commercially available type (suitable units are available from Comair Rotron, Inc., in San Ysidro, Calif., or Sanyo Denki Co. Ltd., in Japan) which regulates fan speed according to the temperature sensed by thermistor 142. Fan speed is thus automatically diminished as the temperature of the hot-sink block decreases when water in the tank has been chilled or the room-air temperature becomes colder. Fan speed is correspondingly increased when a higher rate of heat transfer out of the tank is needed. The control circuitry of the fan can be adjusted to match a specific range of fan speeds with a specific range of sensed temperatures.

Twelve-volt d-c power is provided to thermoelectric chip 131 and fan 140 by a transformer and rectifier assembly 143 (FIG. 3) secured to base panel 14 and positioned within a cavity 145 formed in the bottom of lower shell 13 of the outer housing. The transformer is connected to a standard a-c power outlet, and cabling from the assembly 143 to the thermoelectric chip and fan is omitted from the drawings for clarity.

The thermoelectric chip operates in a conventional way to draw heat from the cold-sink disk (and hence from water in the tank through plate 30 (acting as a kind of secondary cold sink) which is tightly positioned in face-to-face contact with the upper surface of the cold-sink disk) to be dissipated to outside room air by fins 132 which are cooled by air sucked by the fan through base-panel slots 144 into the plenum surrounding the fins. Though the control of cooling action is preferably provided by varying the fan speed (and thus reducing fan noise during "idling" operation when the tank water has been fully chilled), an acceptable alternative is to vary the current supplied to the thermoelectric chip in response to varying heat loads.

Figure 22:
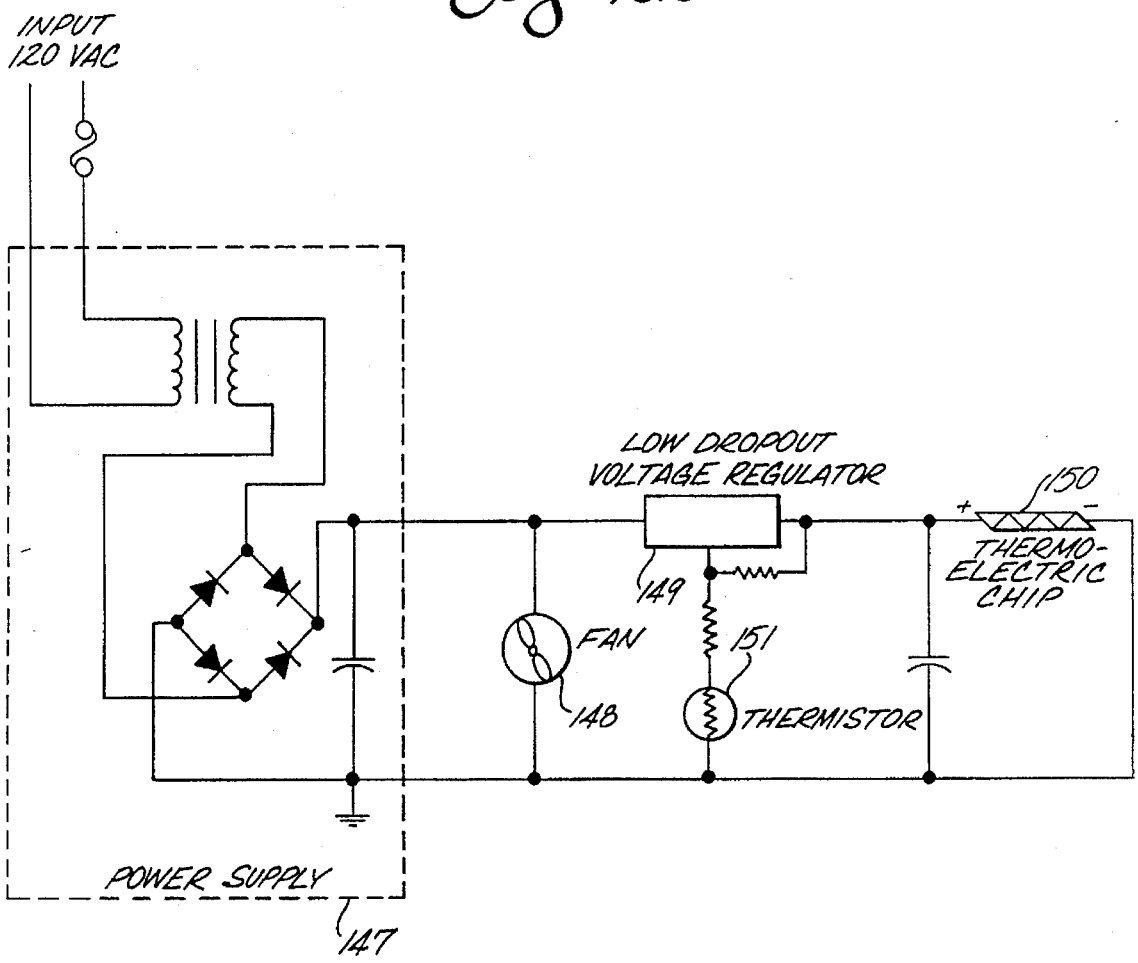
FIG. 22 is a schematic diagram of an alternative circuit for thermistor control of electrical energy delivered to a thermoelectric chip.

FIG. 22 shows a typical arrangement of conventional circuit elements for controlling the operating level of the thermoelectric chip. A transformer, full-wave rectifier, and smoothing capacitor form a power supply 147 for converting a-c line voltage to direct current. A constant-speed fan motor 148 is connected across the power supply, and a low-dropout voltage regulator 149 (a Texas Instruments LT1084C regulator is suitable) in series with a thermoelectric chip 150 is also connected across the d-c output of the power supply. Temperature at a point in the system is sensed by a transducer such as a thermistor 151 which controls regulator 149 to vary the voltage, and hence current flow to chip 150.

Temperature may also be sensed at other points in or external to the system such as at the chip, at the cold sink, in the body of chilled water (the latter approach having the disadvantage of penetration of the tank by the sensor), or in the room air surrounding the system. Sensing of temperature at the hot-sink block, however, is presently preferred, because it provides good control of ice-block buildup and final size responsive to temperature changes in both the chilled water and the room air. As mentioned above, the temperature signal from the sensor may also be used to control a variable current flow to the thermoelectric chip.

In use, thermoelectric chilling assembly 124 forms an ice block 155 (shown in phantom line in FIG. 4) in the bottom of the tank for rapid chilling of room-temperature water admitted from the upper chamber into the lower chamber. Water is dispensed through spigot 105, and temperature of the dispensed water can be adjusted by rotating intermediate sleeve 91 of the valve assembly. The intermediate sleeve has sufficient frictional resistance to rotation to maintain a desired preset position. A mixture of room-temperature and chilled water is provided by positioning the sleeve as shown in FIG. 20. If only room-temperature water is needed, the sleeve is rotated to the position shown in FIG. 21 with lower port 87 of the outer sleeve blocked, and upper port 86 fully open. Clockwise rotation of sleeve 91 to a position opposite that shown in FIG. 21 blocks the upper port, and permits only chilled water to be dispensed through the lower port.

A significant advantage of the invention is the ease of removing tank 24 and thermal-barrier assembly 35 for periodic dishwasher cleaning. Disassembly involves removal of the water bottle, release of clips 57 and upward withdrawal of the thermal-barrier assembly. The thus unclamped valve assembly 73 can then be pulled outwardly within outer tube 74 out of engagement with tank 24 so the tank can be withdrawn from the outer housing. Reassembly involves only a reversal of these steps. The general arrangement of the tank, thermal-barrier assembly, and associated latches make the chiller system well adapted for mounting of a probe used to open resealable caps which are now available for bottled-water containers.

To maintain good cooling efficiency, it is important that stainless-steel plate 30 forming the sealed bottom of the tank be clamped in intimate face-to-face contact with the upper surface of cold-sink disk 126. A degree of resiliency is provided in the system to accommodate tolerance errors of the plastic and metal parts by thick gasket 32 which is only partially compressed when clamping screws 31 are fully seated. Further compression of the gasket permits an "over center" action of clips 57, and the restoring force exerted by the gasket urges plate 30 against the cold-sink disk. The desired resiliency of the system can also be provided by other elastomeric members such as seals 69 and 70, or by using a resilient spring-loaded mounting for the thermoelectric chilling assembly.

There has been described a thermoelectric water-chiller system which provides efficient cooling of bottled water for personal consumption and use, with quiet, reduced-noise operation after the water has been fully chilled. The system is designed to enable ready and simple disassembly for periodic cleaning, and this feature is believed to be equally useful in compressor-type water coolers. The system is not restricted to use with bottled water, and can be adapted for water-treatment systems of the point-of-use type.

What is claimed is:

1. A drinking-water chiller system, comprising:

a housing;

a tank supported on and extending within the housing;

a thermal insulating member suspended within the tank between upper and lower ends of the tank to define an upper zone for room-temperature water and a lower zone for chilled water;

an adjustable proportioning valve mounted on the housing and coupled to the upper and lower zones for dispensing variable proportions of room-temperature and chilled water; and a cooling assembly in the housing, and having a cold-sink plate in contact with the tank, and a heat sink with a heat-dissipating means.

2. The system defined in claim 1 in which the proportioning valve has an inner end which extends into the lower zone of the tank, and further comprising a locking means engaged with the valve for releasably securing the valve in position.

3. The system defined in claim 2 in which the locking means is a member secured to and extending from the thermal insulating member into releasable engagement with the valve inner end.

4. The system defined in claim 3 in which the locking-means member is channel shaped to define in combination with a sidewall of the tank a conduit for passage of room-temperature water from the upper zone to the proportioning valve.

5. The system defined in claim 4 in which the valve comprises an outer sleeve engaged with the locking-means member and having a pair of ports for receiving room-temperature and chilled water, a rotatable intermediate sleeve fitted within the outer sleeve and movable to cover and uncover the ports; an inner sleeve fitted within the intermediate sleeve for conveying water through the housing; and a spigot secured to an outer end of the inner sleeve.

6. The system defined in claim 5 in which the cooling assembly includes a thermoelectric chip positioned between and in contact with the plate and heat sink, in which the heat sink comprises a block with a plurality of heat-dissipating fins, and further comprising a fan in the housing for passing outside air over the fins.

7. The system defined in claim 6, and further comprising a plurality of latch assemblies at an upper end of the housing for releasably securing the tank and thermal-barrier member to the housing.

8. The system defined in claim 1 in which the cooling assembly includes a thermoelectric chip positioned between and in contact with plate and heat sink, and further comprising a temperature sensing means for measuring temperature at a point in the system for controlling current flow to the thermoelectric chip.

9. The system defined in claim 8 in which the temperature sensing means is arranged to measure temperature of the heat sink.

10. The system defined in claim 8 in which the temperature sensing means is arranged to measure air temperature.

11. The system defined in claim 1 in which the heat sink comprises a block with a plurality of heat dissipating fins, and further comprising a variable-speed fan in the housing for passing outside air over the fins, and a temperature sensor for measuring temperature at a point in the system, the sensor being connected to the fan to control fan speed.

12. The system defined in claim 11 in which the cooling assembly includes a thermoelectric chip positioned between and in contact with the plate and block, and in which the temperature sensor is mounted on the heat-sink block.

13. The system defined in claim 11 in which the cooling assembly includes a thermoelectric chip positioned between and in contact with the plate and block, and in which the temperature sensor is arranged to measure air temperature.

14. The system defined in claim 1 in which the tank is arranged to be removable from the housing, the tank having a bottom wall with a central opening, and a plate secured to the bottom wall to close the central opening, and to act as a secondary cold sink.

15. The system defined in claim 14 in which the secondary cold-sink plate is in face-to-face contact with the cold-sink plate.

16. The system defined in claim 14 in which the secondary cold-sink plate is a metal plate, and the temperature sensor is a thermistor.

17. The system defined in claim 11 in which the cooling assembly includes a thermoelectric chip positioned between and in contact with the plate and block, and in which the temperature sensor is mounted on the cold-sink plate.

* * * * *